US007938195B2

(12) United States Patent
Schoeps

(10) Patent No.: US 7,938,195 B2
(45) Date of Patent: May 10, 2011

(54) IMPACT WRENCH WITH A LUBRICATED IMPACT MECHANISM

(75) Inventor: Knut Christian Schoeps, Tyresö (SE)

(73) Assignee: Atlas Copco Tools AB, Stockholm (SE)

( * ) Notice: Subject to any disclaimer, the term of this patent is extended or adjusted under 35 U.S.C. 154(b) by 69 days.

(21) Appl. No.: 12/445,115

(22) PCT Filed: Oct. 8, 2007

(86) PCT No.: PCT/SE2007/000888

§ 371 (c)(1),
(2), (4) Date: Apr. 10, 2009

(87) PCT Pub. No.: WO2008/044981

PCT Pub. Date: Apr. 17, 2008

(65) Prior Publication Data

US 2010/0071924 A1 Mar. 25, 2010

(30) Foreign Application Priority Data

Oct. 13, 2006 (SE) ..... 0602151

(51) Int. Cl.
*B25B 21/02* (2006.01)

(52) U.S. Cl. ..... 173/93.5; 173/48; 173/132; 173/93; 173/117

(58) Field of Classification Search ..... 173/93.5, 173/93, 48, 132, 117
See application file for complete search history.

(56) References Cited

U.S. PATENT DOCUMENTS

| | | | | |
|---|---|---|---|---|
| 2,881,885 | A | | 4/1959 | Short |
| 3,144,108 | A | | 8/1964 | Reynolds |
| 3,561,543 | A | | 2/1971 | Ulbing |
| 3,648,784 | A | | 3/1972 | Schoeps |
| 3,661,217 | A | | 5/1972 | Maurer |
| 3,837,410 | A | * | 9/1974 | Maxwell ..... 173/109 |
| 4,157,120 | A | | 6/1979 | Anderson |
| 4,635,731 | A | | 1/1987 | Wallace et al. |
| 4,977,966 | A | * | 12/1990 | Farber et al. ..... 173/159 |
| 6,044,917 | A | * | 4/2000 | Brunhoelzl ..... 173/93.5 |
| 6,782,956 | B1 | * | 8/2004 | Seith et al. ..... 173/1 |
| 7,331,404 | B2 | * | 2/2008 | Pusateri ..... 173/93.5 |
| 7,628,221 | B2 | * | 12/2009 | Hartmann et al. ..... 173/104 |
| 7,654,338 | B2 | * | 2/2010 | Herting et al. ..... 173/48 |
| 2006/0144601 | A1 | | 7/2006 | Pusateri |

FOREIGN PATENT DOCUMENTS

JP 2002-307324 A 10/2002

OTHER PUBLICATIONS

Extended European Search Report dated Feb. 4, 2010 (5 pages), issued in counterpart European Application No. 07835090.7.

* cited by examiner

*Primary Examiner* — Brian D Nash
(74) *Attorney, Agent, or Firm* — Holtz, Holtz, Goodman & Chick, PC

(57) ABSTRACT

An impact wrench includes a housing, a rotation motor, an output shaft, and an impact mechanism including an inertia drive member with an impact chamber, a drive socket coupling the drive member to the motor, and anvil formed integral with an output shaft and extending into the impact chamber, and a coupling member arranged to transfer kinetic energy from the drive member to the anvil, a lubricant provided in the impact chamber, and barrier forming cover element mounted on the drive member to seal off the impact chamber and prevent lubricant from being expelled from the impact chamber at rotation of the drive member.

6 Claims, 1 Drawing Sheet

IMPACT WRENCH WITH A LUBRICATED IMPACT MECHANISM

This application is a U.S. National Phase Application under 35 USC 371 of International Application PCT/SE2007/000888 filed Oct. 8, 2007.

FIELD OF THE INVENTION

The invention relates to an impact wrench with an impact mechanism comprising a motor driven inertia drive member with an internal impact chamber, an anvil forming the output shaft and extending into the impact chamber, and a coupling means in the impact chamber for transferring kinetic energy from the drive member to the anvil at impact generation.

BACKGROUND OF THE INVENTION

Impact wrenches of the above type are previously described in for instance U.S. Pat. No. 3,648,784 and U.S. Pat. No. 3,661,217.

A problem related to impact wrenches of the above described type is mechanical wear and a limited service life due to poor lubrication of the parts of the impact mechanism. Lubricant in the form of grease that is applied at the assemblage of the impact mechanism, and also supplied after some intervals of use, tends not to stay within the impact mechanism but is expelled from the rotating drive member and is deposited on the inside walls of the wrench housing. Grease gathered on the inside walls of the housing is of no use but could instead, if gathered in a too large quantity, cause a braking effect on the drive member and, hence, a reduction in power output of the impact wrench.

BRIEF SUMMARY OF THE INVENTION

The main object of the invention is to create an improved impact wrench where the lubricant is prevented from leaving the impact mechanism, thereby substantially reducing the mechanical wear of the impact mechanism as well as the risk for reduction in power output.

Another object of the invention is to create an impact wrench where the impact mechanism is properly lubricated and at the same time the number of service occasions where more lubricant grease is added is substantially reduced.

A preferred embodiment of the invention is below described in detail with reference to the accompanying drawing.

According to one aspect of the present invention, an impact wrench includes a housing, a rotation motor, an output shaft, and an impact mechanism including a drive member coupled to the motor and defining an impact chamber, an anvil formed integral with the output shaft and extending into the impact chamber, and a hammer device in the impact chamber which transfers kinetic energy from the drive member to the anvil at impact generation, wherein a lubricant is provided in the impact chamber, and wherein the impact mechanism comprises a barrier forming cover element having: (i) a first cylindrical portion surrounding an outer periphery of the drive member and extending axially over at least a part of the length of the drive member; and (ii) a second transverse portion covering one end of the drive member, whereby the cover element is arranged to prevent lubricant from being expelled from the impact chamber at rotation of the drive member.

DETAILED DESCRIPTION OF THE INVENTION

Figure 2:
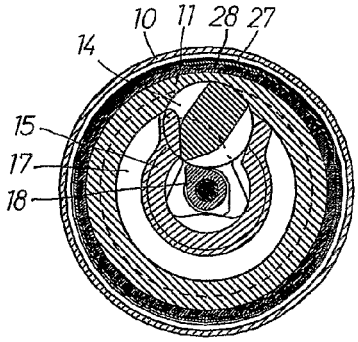
FIG. 2 shows a cross section along line II-II in FIG. 1.
Figure 1:
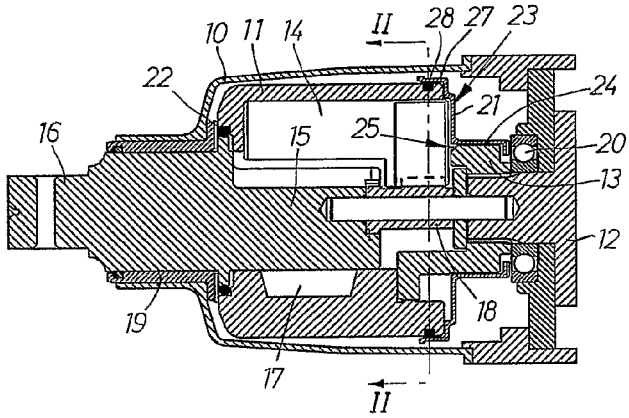
FIG. 1 shows a longitudinal section through an impact mechanism according to one embodiment of the invention.

The impact mechanism illustrated in FIGS. 1 and 2 comprises a housing 10, an inertia drive member 11 coupled to a motor (just fragmentary illustrated) via a drive socket 13 and a hammer element 14 which is pivotally supported on the drive member 11, and an anvil 15 forming a one piece element with an output shaft 16. A cam element 18 is rotationally locked relative to the anvil 15 and arranged to shift the hammer element 14 from a free running position to an impact delivering position at relative rotation between the drive socket 13 and the drive member 11. The drive member 11 is hollow and encloses an impact chamber 17, and the anvil 15 extends into the impact chamber 17 for receiving rotational hammer blows from the hammer element 14. At its forward end the output shaft 16 is supported relative to the housing 10 via a bearing sleeve 19 and at its rear end via the drive member 11 and a roller bearing 20. The operation order of the impact mechanism is not described in further detail since it is well known in the art and described in the U.S. Pat. No. 3,648,784.

At its forward end the drive member 11 is provided with a seal ring 22 to seal off the impact chamber 17 relative to the output shaft 16. At its rear end the drive member 11 is provided with a barrier forming cover element 23 which is made of sheet metal and comprises a transverse portion 21 and a tubular neck portion 24 extending co-axially with and forming a clearance seal 25 relative to the drive socket 13. The cover element 23 has an outer cylindrical portion 27 surrounding the outer periphery of the rear end of the drive member 11, and an O-ring 28 is fitted on the drive member 11 to form a tight connection relative to the cover element 23. By the seal ring 22 and the barrier forming cover element 23 including the clearance seal 25 and the O-ring 28 the impact chamber 17 is sealed off relative to the housing 10 with the purpose to prevent the grease from leaving the impact chamber 17 and be deposited on the inside wall of the housing 10.

Figure 4:
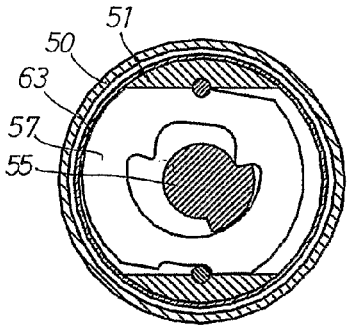
FIG. 4 shows a cross section along line IV-IV I FIG. 3.
Figure 3:
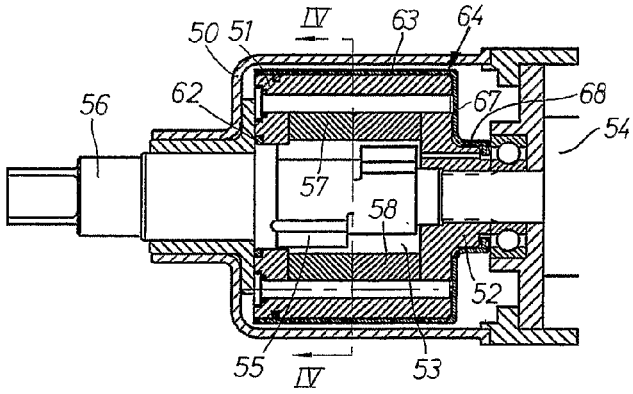
FIG. 3 shows a longitudinal section through an impact mechanism according to another embodiment of the invention.

The impact mechanism illustrated in FIGS. 3 and 4 comprises a housing 50, an inertia drive member 51 coupled to a rotation motor 54 (just fragmentary illustrated) via a rear socket portion 52. The drive member 51 is substantially cylindrical in shape and defines an impact chamber 53. An anvil 55 is formed integral with an output shaft 56 and extends into the impact chamber 53. Two hammer elements 57, 58 are pivotally supported on the drive member 51 and formed with cam means 60 for co-operation with the anvil 55 to thereby shift the hammer elements 57, 58 from free running positions to impact delivering positions at relative rotation between the drive member 51 and the anvil 55. The operation order of the impact mechanism is not described in further detail since it is well known per se and described in U.S. Pat. No. 3,661,217.

The impact chamber 53 is sealed off at its forward end relative to the output shaft 56 by an 0-ring 62 and in the radial direction by a barrier forming cover element 64 which comprises an outer portion 63 that extends axially over the main part of the drive member 51 and is sealed off by an 0-ring 65 on the drive member 51. The cover element 64 also has a rear transverse portion 67 and an inner sleeve shaped portion 68 engaging the socket portion 52 of the drive member 51. The cover element 64 forms an enclosing barrier with the purpose to prevent the lubricating grease from being expelled from the impact chamber 53 and deposited on the inner walls of the housing 50.

By providing a barrier forming cover element it is ensured that the impact mechanism is not running out of lubricating grease and being exposed to severe mechanical wear. The result is substantially reduced number of costly service occasions and an extended service life of the impact mechanism.

The invention claimed is:

1. An impact wrench comprising:

a housing;

a rotation motor; and a torque impact mechanism located in the housing, wherein the torque impact mechanism includes:

a rotary drive member with an impact chamber and a socket portion connected to the motor;

an anvil extending into the impact chamber and formed integral with an output shaft extending out of the housing;

at least one hammer element supported in the impact chamber and arranged to transfer rotary kinetic energy from the rotary drive member to the anvil at impact generation;

a lubricant provided in the impact chamber; and a lubricant barrier forming cover element including: (i) a first cylindrical portion surrounding an outer periphery of the rotary drive member and extending axially over at least a part of a length of the rotary drive member, (ii) a transverse portion covering one end of the rotary drive member, and (iii) a second cylindrical portion extending co-axially with and forming a seal relative to the socket portion, whereby the lubricant barrier forming cover element is arranged to prevent the lubricant from being expelled from the impact chamber into the housing at rotation of the rotary drive member.

2. The impact wrench according to claim 1, wherein said seal between said second cylindrical portion and said socket portion is formed by a clearance seal.

3. The impact wrench according to claim 2, wherein said lubricant barrier forming cover element is made of sheet metal.

4. The impact wrench according to claim 1, wherein said first cylindrical portion of the lubricant barrier forming cover element extends axially over substantially an entire length of the rotary drive member.

5. The impact wrench according to claim 4, wherein said lubricant barrier forming cover element is made of sheet metal.

6. The impact wrench according to claim 1, wherein said lubricant barrier forming cover element is made of sheet metal.

* * * * *